United States Patent [19]

Burke

[11] 4,300,764

[45] Nov. 17, 1981

[54] BASKETBALL HOOP WITH SHIELD

[75] Inventor: William B. Burke, Springfield, Mass.

[73] Assignee: William Burke Associates, Inc., Springfield, Mass.

[21] Appl. No.: 107,667

[22] Filed: Dec. 27, 1979

[51] Int. Cl.[3] ..... A63B 63/08

[52] U.S. Cl. ..... 273/1.5 R; 273/395

[58] Field of Search ..... 273/1.5 R, 1.5 A, 395, 273/DIG. 31

[56] References Cited

U.S. PATENT DOCUMENTS

| | | | |
|---|---|---|---|
| 2,838,308 | 6/1958 | Polite | 273/1.5 R |
| 2,889,149 | 6/1959 | Williams | 273/1.5 R X |
| 3,025,058 | 3/1962 | Brumfield | 273/1.5 R |
| 3,134,594 | 5/1964 | Crowley | 273/1.5 R X |
| 3,342,486 | 9/1967 | Farley | 273/1.5 A |
| 3,388,909 | 6/1968 | Woods | 273/1.5 R |
| 3,427,026 | 2/1969 | Mahoney | 273/1.5 A |
| 3,799,543 | 3/1974 | Steele, Jr. | 273/1.5 A |
| 4,082,269 | 4/1978 | Hill | 273/1.5 R |

*Primary Examiner*—Paul E. Shapiro
*Attorney, Agent, or Firm*—Harvey B. Jacobson

[57] ABSTRACT

A basketball hoop or goal associated with a backboard in a conventional manner with the hoop including a laterally extending, downwardly inclined shield terminating in a peripheral ring located outwardly of the annular ring defining the hoop or goal through which the ball passes to score points when playing basketball. The shield requires that players release the ball at a point spaced peripherally of the rim of the hoop thereby eliminating the capability of the players "dunking" the ball through the hoop. The replacement of the conventional hoop and net with the hoop and shield reduces the advantages that tall players have while increasing emphasis on speed, team work, long range shooting ability and finesse while decreasing slam dunking, hanging on baskets and contact fouls by spreading the players out rather than having them concentrated in a very small area under the conventional basket.

6 Claims, 3 Drawing Figures

BASKETBALL HOOP WITH SHIELD

BACKGROUND OF THE INVENTION

1. Field of the Invention

The present invention generally relates to a basket ball goal which replaces the conventional hoop and net with a hoop forming the inner ring of a downwardly and outwardly inclined shield oriented peripherally of the hoop with an outer rim being rigidly fixed to the backboard and defining the outer periphery of the shield with the length and angle of the shield being such as to preclude the ball from being dunked through the hoop and providing a varied trajectory to the ball as it rebounds when the ball misses the hoop. 2. Disclosure Statement In recent years, basketball has evolved into a contact between large tall players capable of dominating the area under the basket and slam dunking the ball through the hoop. Various rule changes have been made with respect to penalties for certain actions but the structure of the basketball hoop and net itself has not materially altered for many years. Many injuries have resulted from players' arms and heads coming into contact with the hoop and basketball hoops have been bent and backboards destroyed by virtue of the player's arms coming into contact with the hoop when slam dunking the ball. As basketball teams have concentrated on scoring points with tall players, there has been a reduced emphasis on team work, team speed, running plays and finesse to the extent that shorter players are more or less excluded from basketball even though they may have considerable speed, agility and other talents for playing basketball. The following U.S. Pat. Nos. relate to this field of endeavor: 2,889,149, 2,918,283, 3,134,594, 3,233,896, 3,342,486, 3,602,505, 3,948,516.

Of the above patents, U.S. Pat. No. 3,134,594, issued May 26, 1964 to Crowley, is relevant since it discloses a circular net for the purpose of compelling a player to shoot at the basket from a distance spaced from the rim of the hoop.

SUMMARY OF THE INVENTION

An object of the present invention is to provide a basketball hoop and shield which replaces the conventional hoop and net but is associated with the backboard in the same manner as a conventional hoop and net so that players must release the ball before the ball enters the hoop thereby preventing a player from dunking the ball through the hoop.

Another object of the invention is to provide a basketball hoop and shield in which the shield includes a peripheral rim at the outer edge of the shield oriented in a manner that the shield varies in its downward inclination from a rather steep angle at the front of the hoop to a rather shallow angle at the sides of the hoop adjacent the backboard so that the trajectory of rebounds toward the sidelines adjacent the base line will be a relatively high or short trajectory whereas rebounds towards the center of the court will be relatively flat and longer thus keeping the ball in play more often when rebounding toward the sidelines and providing greater opportunities for fast breaks when rebounded towards the center of the court.

A further object of the invention is to provide a basketball hoop and shield which is mounted on a conventional backboard as a replacement for a conventional hoop and net which requires that shots be taken towards the hoop from a greater distance and substantially eliminating the slam dunk or tip in shot from under the basket which reduces the advantages of tall players and increases the emphasis on team play, speed and shot accuracy.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
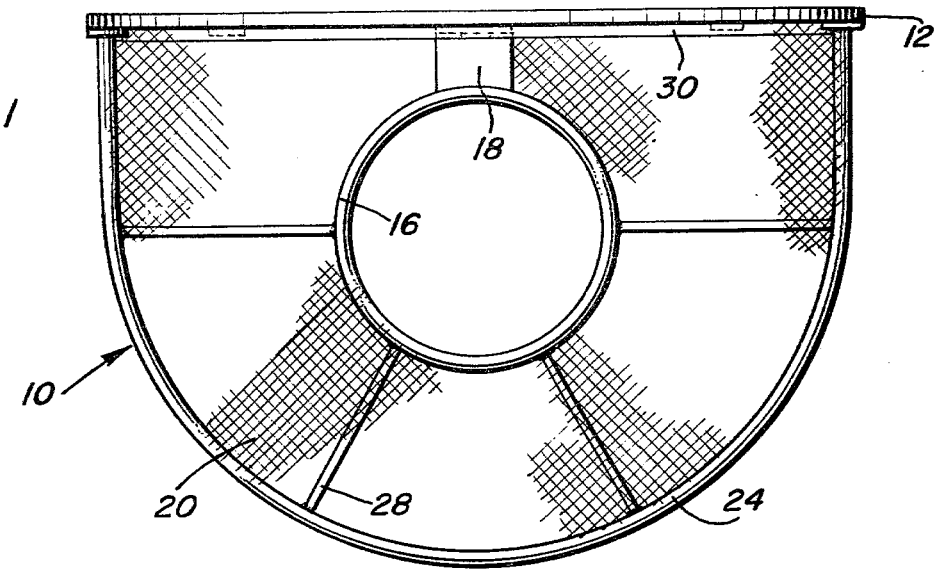
FIG. 1 is a plan view of the basketball hoop and shield of the present invention.

Referring now specifically to the dawings, the basketball hoop and shield of the present invention is designated generally by reference numeral 10 and is associated with a conventional basketball backboard 12 which is oriented in vertical position and is of conventional shape, either rectangular or provided with angulated bottom edge portions and an arcuate top edge portion and supported in any suitable manner in a vertical position with the support structure for the backboard being generally designated by numeral 14 and forming no particular part of the present invention.

Figure 2:
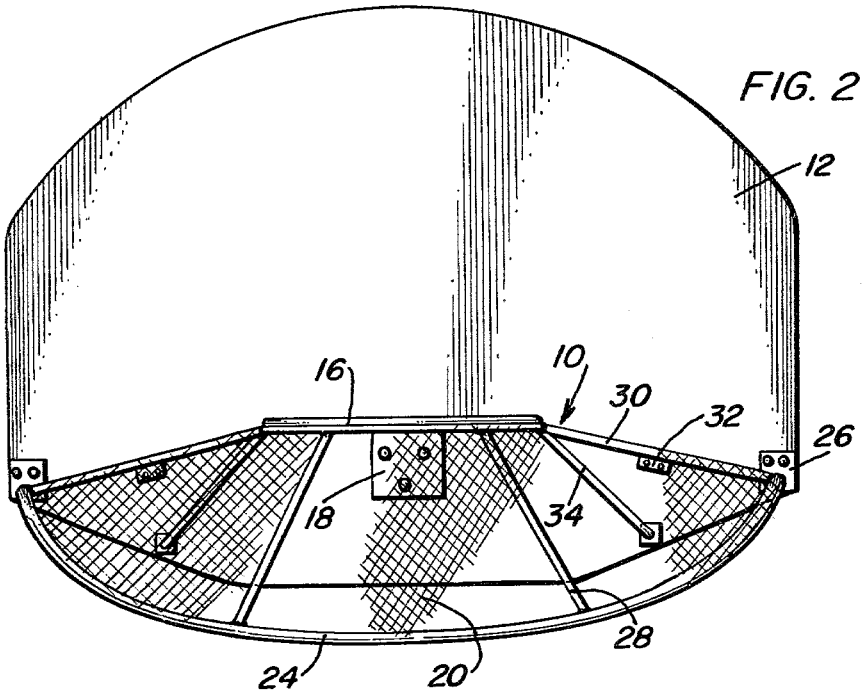
FIG. 2 is a front elevational view of the present invention.
Figure 3:
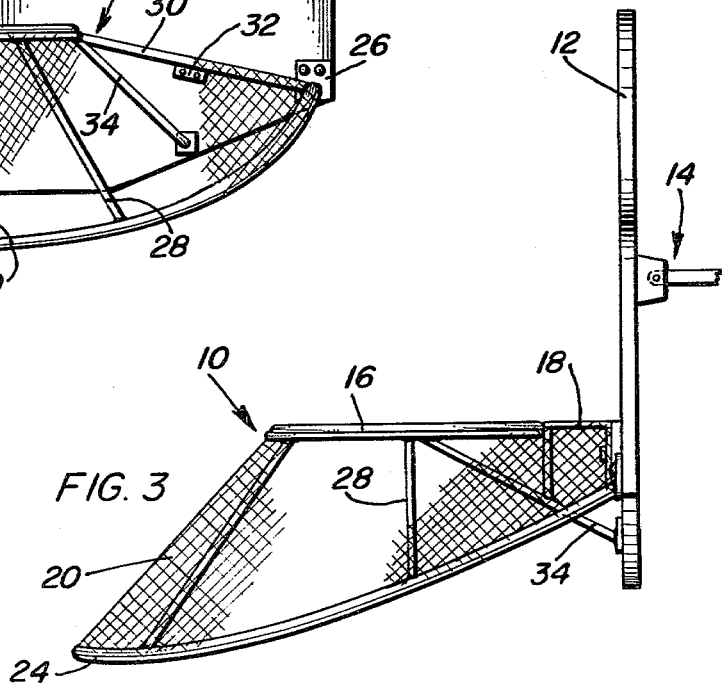
FIG. 3 is a side elevational view of the invention.

The basketball hoop and shield 10 includes an annular inner ring 16 which is identical to the shape and size of a conventional basketball hoop with the inner periphery thereof being supported from the backboard 12 by a conventional bracket structure 18 which spaces the inner periphery of the hoop from the backboard a standard distance. Rather than having a net suspended from the hoop 16 as in a conventional basketball hoop, the net along with its attachment structure has been eliminated. In lieu of the net, a laterally extending and downwardly inclined shield 20 is attached to or formed integrally with the periphery of the hoop 16 with the shield extending throughout the periphery of the hoop 16 and along the side edges of the bracket 18 and terminating against the face of the backboard 12. The outer periphery of the shield 20 is formed by an outer rim 24 of generally U-shaped configuration as observed in the plan view of FIG. 1 and angulated as disclosed in FIGS. 2 and 3 with the terminal ends of the rim 24 being attached to the lower corners of the backboard 12 by suitable bracket structure 26. As illustrated, the inner periphery of the shield 20 is disposed at the bottom edge of the hoop 16 so that the inner rim which forms the hoop through which the ball passes will always be visible to the players so that it can be used as a fixed reference point as a target for the ball. A plurality of radially extending bars 28 extend from the hoop 16 to the outer rim 24 and are rigidly fixed thereto in a suitable manner to provide support for the shield 20 and where the shield 20 engages the backboard 12, the bars 30 include bracket 32 secured to the backboard with the upper ends of the bars 30 extending to and connecting to the side edges of the standoff bracket 18. Additional bracing 34 may be provided between the bottom of the backboard and the periphery of the hoop 16 to provide better support for the hoop 16 and the outer rim 24 may be padded, if desired, to protect players who come into contact with the outer rim. The shield 20 may be constructed of heavy wire mesh adequately supported by supporting rods or framework or it may be constructed of a rigid framework of intersecting rigid rods or tubes welded together to provide a rigid shield capable of effecting rebounding the ball and capable of long periods of use by basketball players. The backboard may actually be constructed larger than conventional since a greater area of the backboard can be positioned below the hoop to provide added support therefore.

When using the basketball hoop and shield of the present invention, the hoop 16 is actually the top edge of the shield and defines the hole through which the ball must pass in order to score points. Since any ball passing outwardly of the hoop 16 will rebound from the shield 20, there is no need for a net suspended from the hoop 16. The shield 20 is at a greater angle at the front of the hoop as compared to the sides thereof with the front angle being generally in the area of 45° and the side angle being generally in the area of 10° so that balls rebounding toward the sidelines, especially adjacent the baseline, will rebound in a high arc or high trajectory and a shorter distance thereby eliminating many out of bounds rebounds, thus keeping the ball in play for a greater proportion of the playing time. The greater angle toward the center of the court causes a rebound to move in a shallow trajectory or a longer distance toward the center of the court, thereby increasing fast break opportunities and also keeping the players spread out so that they do not concentrate under the basket and fight for rebounds which causes considerable fouling and excessive and unnecessary contact. Thus, with this invention, the incidents of slam dunking and hanging on baskets will be eliminated and there will be a decrease in the dominance of extremely tall players and a corresponding increase in emphasis on speed, team work, long range shooting ability, team position for defensive rebounding, running plays which develop away from the usual post-type supports for the basket thus reducing player injury, fast break opportunities and finesse of the players regardless of their height. There will be a substantial decrease in the fouls as the players will be spread apart in a larger area especially when rebounding and the variation in the angle of the shield retains rebounded balls within the court and increases the possibility of fast breaks especially if the rebound is toward the center of the court. All of these factors increase the speed and continuity of the game and increase the capability of spectators following play of the game thereby increasing their interest and enjoyment of the game.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A basketball hoop and shield adapted to be used in combination with a backboard and comprising an annular hoop, bracket means adapted to support the hoop from the backboard in horizontal position to define a hole through which a basketball must pass in order to score points, and a downwardly and outwardly inclined shield having an inner periphery adjacent the hoop to require a player to release a ball aimed for the hoop prior to his hand or hands reaching the hoop and providing a rebound surface for engagement by balls missing the hoop, said shield being in the form of a periphery continuous panel having an inner edge adjacent the hoop, an outer rim attached to the outer edge of the panel and adapted to be supported from the backboard, the angle of the panel being greater at the front of the hoop and less at the sides of the hoop whereby rebound balls will have a high and short trajectory toward the sidelines of the basketball court and a shallow and long trajectory towards the center of the basketball court.

2. The structure as defined in claim 1 wherein said panel is constructed of rigid mesh material, a plurality of radially extending support rods interconnecting the hoop and outer rim, the edges of the panel adapted to be supported from the backboard including a supporting rod and bracket adapted to be connected to the backboard.

3. The structure as defined in claim 2 wherein said bracket means includes a rigid bracket attached to the inner portion of the hoop, and brace rods connected to the side peripheral portions of the hoop and adapted to extend downwardly and connected to the backboard.

4. The structure as defined in claim 1 wherein said shield is rigidly affixed to the hoop along the undersurface thereof to enable continuous observation of the hoop by players as a target when shooting the ball.

5. The structure as defined in claim 1 wherein said shield has a lateral extent sufficient to preclude players from dunking the basketball and precluding tip-in shots from under the basket, thereby reducing the advantages of tall players and increasing the range of rebound of basketballs thereby spreading the players over a larger portion of the basketball court when rebounding.

6. In combination with a basketball goal in the form of a single annular hoop supported in horizontal position in front of a vertical backboard, a shield comprising a downwardly and outwardly inclined member adapted to closely encircle the hoop and having a lateral dimension to preclude players from touching a basketball when it is within the plane of an imaginary cylinder extending upwardly from the hoop to prevent dunking the basketball down through the hoop, said inclined member being rigid and providing an inclined rebound surface adapted to extend substantially across the front of the backboard and peripherally of the hoop, said inclined member having a greater angle of inclination at the front and less at the sides for providing a high, short rebound trajectory to the sides and a shallow, long rebound trajectory to the front of the hoop.

* * * * *